US006054649A

United States Patent [19]

Uchida et al.

[11] Patent Number: 6,054,649

[45] Date of Patent: Apr. 25, 2000

[54] INSULATED WIRE WITH NOISE-SUPPRESSING FUNCTION

[75] Inventors: Katsuyuki Uchida, Hikone; Masami Sugitani, Omihachiman; Yukio Sakamoto, Moriyama, all of Japan

[73] Assignee: Murata Manufacturing Co., Ltd., Nagaokakyo, Japan

[21] Appl. No.: 09/131,168

[22] Filed: Aug. 7, 1998

[30] Foreign Application Priority Data

Aug. 8, 1997 [JP] Japan ..... 9-214588

[51] Int. Cl.[7] ..... H01B 7/34; H01B 11/06

[52] U.S. Cl. ..... 174/36; 333/12; 333/243; 336/175

[58] Field of Search ..... 174/36, 74 R; 333/12, 243; 336/90, 174, 175, 98

[56] References Cited

U.S. PATENT DOCUMENTS

| | | | |
|---|---|---|---|
| 2,121,883 | 6/1938 | Parker | 336/175 X |
| 2,932,805 | 4/1960 | Doherty | 333/243 |
| 3,392,326 | 7/1968 | Lamberton | 336/174 X |
| 3,507,976 | 4/1970 | Thompson et al. | 174/74 R |
| 4,399,419 | 8/1983 | Dobrovolny | 333/12 |
| 4,656,451 | 4/1987 | Pomponio | 333/12 X |
| 4,699,743 | 10/1987 | Nakamura et al. | 264/104 |
| 4,843,356 | 6/1989 | Lusignan et al. | 174/36 X |
| 4,972,459 | 11/1990 | Sommer | 336/175 X |
| 5,089,666 | 2/1992 | DiVila | 174/74 R |
| 5,149,916 | 9/1992 | Baker et al. | 174/74 R |
| 5,200,730 | 4/1993 | Masuda et al. | 333/12 X |
| 5,287,074 | 2/1994 | Meguro et al. | 333/12 |
| 5,763,825 | 6/1998 | Gilliland | 174/36 |

*Primary Examiner*—Kristine Kincaid
*Assistant Examiner*—Chau N. Nguyen
*Attorney, Agent, or Firm*—Burns, Doane, Swecker & Mathis, LLP

[57] ABSTRACT

An insulated wire with a noise-suppressing function includes a ring-shaped magnetic core, a coated wire inserted into the hole of the ring-shaped magnetic core, and a securing member for securing the ring-shaped magnetic core to the coated wire. The inner diameter of the ring-shaped magnetic core, namely the diameter of the hole, is set smaller than the outer diameter of the coated wire. The coated wire is formed of a pair of parallel conductive wires, a wire-coating member for coating the pair of conductive wires, and a sheath for covering the wire-coating member. The sheath is removed at one end of the coated wire. A part of the conductive wires which is coated only with the wire-coating member is inserted into the hole of the ring-shaped magnetic core.

14 Claims, 6 Drawing Sheets

INSULATED WIRE WITH NOISE-SUPPRESSING FUNCTION

BACKGROUND OF THE INVENTION

1. Field of the Invention

The present invention relates to an insulated wire with a noise-suppressing function, and more particularly, to an insulated wire with a noise-suppressing function used for a signal line.

2. Description of the Related Art

A known method for suppressing high-frequency noise which has entered a signal line is shown in FIG. 9. In the method, two divided core pieces 81*a* and 81*b* are accommodated in a cylindrical case 82 which can be divided into two sections. An insulated wire 83 is sandwiched by the two core pieces 81*a* and 81*b*. A ring-shaped magnetic core 81 formed by the divided core pieces 81*a* and 81*b* is secured to the periphery of the insulated wire 83 by the use of case fasteners 82*a* and 82*b* provided for the case 82. An advantage of this method is that the ring-shaped magnetic core 81 can be easily placed on the insulated wire 83 afterwards.

Another known method is shown in FIGS. 10 and 11, in which an insulated wire 83 is inserted into a ring-shaped magnetic core 91 and the ring-shaped magnetic core 91 is covered by a resin material 93 to secure the core to the insulated wire 83. An advantage of this method is that the user cannot easily remove the ring-shaped core 91 from the insulated wire 83 and this ensures that high-frequency noise is positively suppressed.

In the configurations shown in FIGS. 9 and 10, however, since the insulated wire 83 is inserted into the ring-shaped magnetic cores 81 and 91, the inner diameters of the cores 81 and 91 need to be set larger than the outer diameter of the insulated wire 83. Therefore, large and heavy ring-shaped magnetic cores 81 and 91 have to be used in order to obtain the desired noise suppression effect.

SUMMARY OF THE INVENTION

Accordingly, it is an object of the present invention to provide an insulated wire with a noise-suppressing function, in which a ring-shaped magnetic core can be made more compact and lightweight.

The foregoing object is achieved according to the present invention through a provision of an insulated wire with a noise-suppressing function, wherein a part of a coated wire where a coating member is removed is inserted into a ring-shaped magnetic core having an inner diameter smaller than the outer diameter of the coated wire. Further, a securing member made from at least one of either resin or rubber secures the ring-shaped magnetic core to the coated wire. The coating member of the coated wire may be removed in the radial direction of the wire at least in part. It is not necessary for the whole coating member to be removed.

As will be clearly understood from the following description, according to the present invention, since a part of a coated wire where a coating member is removed is inserted into a ring-shaped magnetic core having a smaller inner diameter than the outer diameter of the coated wire, the same noise-suppressing effect as in the conventional configuration is obtained with a more compact and more lightweight ring-shaped magnetic core than in the conventional configuration, and the cost is reduced because of a reduction in the amount of the material of a magnetic member.

Since the impedance of a ring-shaped magnetic core is proportional to (outer diameter−inner diameter)/(outer diameter+inner diameter), with the impedance being the same, if the inner diameter is set smaller than before, the outer diameter is relatively made smaller. Therefore, the same noise-suppressing capability as in the conventional configuration is obtained with a smaller-sized ring-shaped magnetic core.

When a securing member made from at least one of either resin or rubber includes magnetic powder, noise-suppressing effects are obtained by the securing member having the magnetic powder as well as by the ring-shaped magnetic core. Since a securing member that includes magnetic powder has a stronger noise-suppressing effect than a ring-shaped magnetic core in a high-frequency band (GHz band), the insulated wire with the noise-suppressing function can suppress noise in a wide frequency band.

When the ring-shaped magnetic core is formed of a plurality of divided core pieces, it can be mounted on the insulated wire at any position. As a result, there are no limitations where the ring-shaped magnetic core can be mounted along the length of the wire.

Since the size of the ring-shaped magnetic core can be made small, when a securing bushing is formed of a securing member made from at least one of either resin or rubber and including magnetic powder, the securing member including the magnetic powder, in which the ring-shaped magnetic core is housed, is only slightly larger in size than a conventional securing bushing without a magnetic core, and the size is not noticeably increased even with the ring-shaped magnetic core. A noise-suppressing function is obtained in a wide frequency band with the use of the ring-shaped magnetic core and the securing member having the magnetic powder. As a result, the portion where the ring-shaped magnetic core is mounted does not serve as an obstacle, and the insulated wire with a noise-suppressing function can be handled easily.

BRIEF DESCRIPTION OF THE DRAWINGS

The foregoing and other, objects, features and advantages of the present invention will be more readily understood upon reading the following detailed description in conjunction with the drawings in which.

DESCRIPTION OF THE PREFERRED EMBODIMENTS

Figure 1:
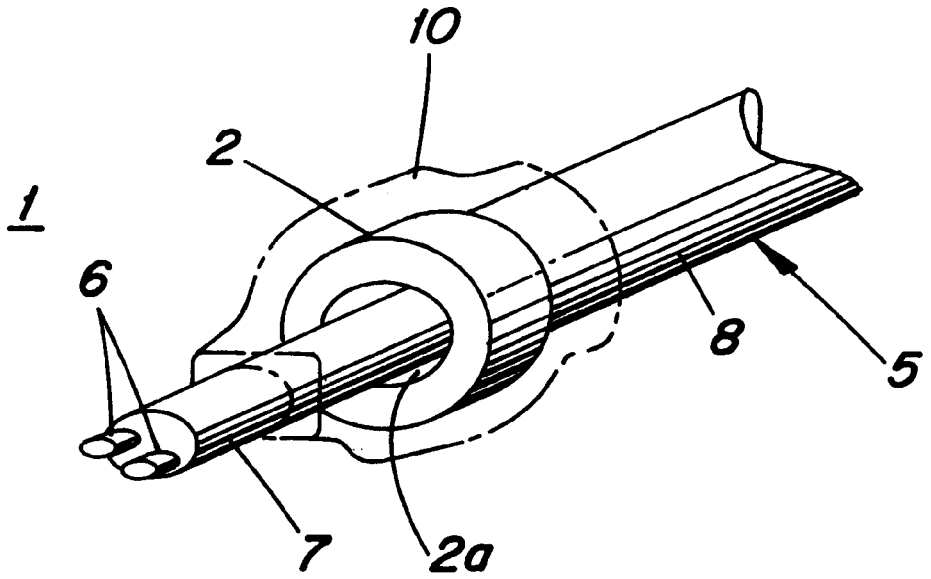
FIG. 1 is a perspective view of an insulated wire with a noise-suppressing function according to a first exemplary embodiment of the present invention.

Embodiments of an insulated wire with a noise-suppressing function according to the present invention will be described below by referring to the drawings. In each embodiment, the same symbols are assigned to the same components or the same portions.

Figure 2:
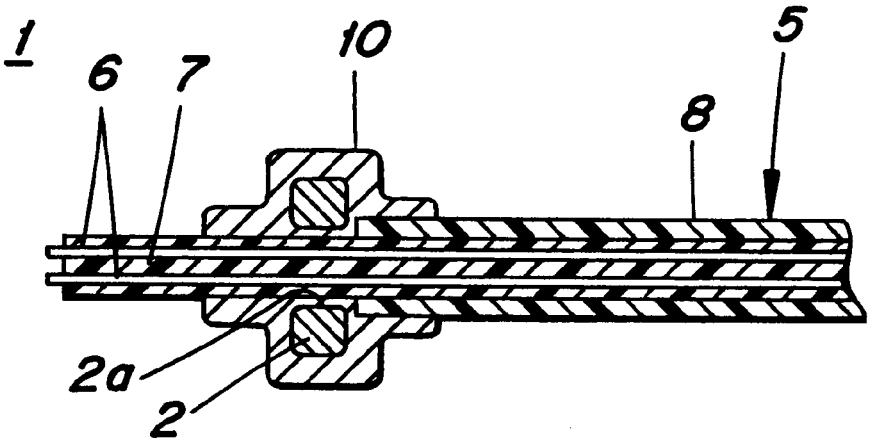
FIG. 2 is a cross sectional view of the insulated wire with the noise-suppressing function shown in FIG. 1.

FIGS. 1 and 2 show an insulated wire 1 with a noise-suppressing function according to a first embodiment of the present invention. It includes a ring-shaped magnetic core 2, an insulated wire 5 passing through the hole 2*a* of the ring-shaped magnetic core 2, and a securing member 10 for securing the ring-shaped magnetic core 2 to the insulated wire 5. The inner diameter of the ring-shaped magnetic core 2, namely the diameter of the hole 2*a*, is set smaller than the outer diameter of the insulated wire 5. The material of the ring-shaped magnetic core 2 is, for example, Ni—Zn ferrite, Mn—Zn ferrite, or Mg—Zn ferrite. In the first embodiment, Ni—Zn ceramic ferrite having a relative magnetic permeability of about 500 is used.

The insulated wire 5 is formed of a pair of conductive wires 6 disposed in parallel to each other, a wire-coating member 7 for coating the pair of conductive wires 6, and a sheath 8 for coating the wire-coating member 7. Copper wire or soldered wire, for example, is used for the conductive wires 6. Vinyl chloride or urethane resin, for example, is used for the wire-coating member 7 and the sheath 8. The term "sheath" used herein is broad, meaning any coating member which is disposed around the wires 6. The sheath 8 is removed at one end of the insulated wire 5. A part of the conductive wires 6, coated only with the wire-coating member 7, is inserted into the hole 2*a* of the ring-shaped magnetic core 2.

The ring-shaped magnetic core 2 is disposed in the vicinity of the end of the sheath 8 and is secured to the end of the insulated wire 5 by placing the securing member 10 thereon. At least one of either resin or rubber is used for the securing member 10. Since resin and rubber are flexible, they also function as a damping material against mechanical stress applied to the ring-shaped magnetic core 2. In the first embodiment, vinyl chloride or like material is used for the securing member 10.

In the insulated wire 1 with the noise-suppressing function having the above structure, the sheath 8 is removed at one end of the insulated wire 5 and the end of the insulated wire 5 is inserted into a ring-shaped magnetic core 2 having a smaller inner diameter than the conventional core. Since the impedance of the ring-shaped magnetic core 2 is proportional to (D1−D2)/(D1+D2), where D1 indicates the outer diameter of the ring-shaped magnetic core 2 and D2 indicates the inner diameter, with the impedance being the same, if the inner diameter can be made smaller than the conventional inner diameter, the outer diameter is also made relatively smaller. In other words, if the inner diameter can be set to two-thirds the conventional inner diameter, the outer diameter can also be set to two-thirds the conventional outer diameter. The volume of the ring-shaped magnetic core becomes one-half the conventional volume or less. Therefore, the same noise-suppressing capability as in the conventional configuration can be obtained with the ring-shaped magnetic core 2 having a smaller size than the conventional configuration. Further, when a ring-shaped magnetic core 2 having the same outer diameter as the conventional outer diameter is used, an insulated wire 1 with a noise-suppressing function having a better noise-suppressing capability than the conventional configuration can be obtained.

Figure 3:
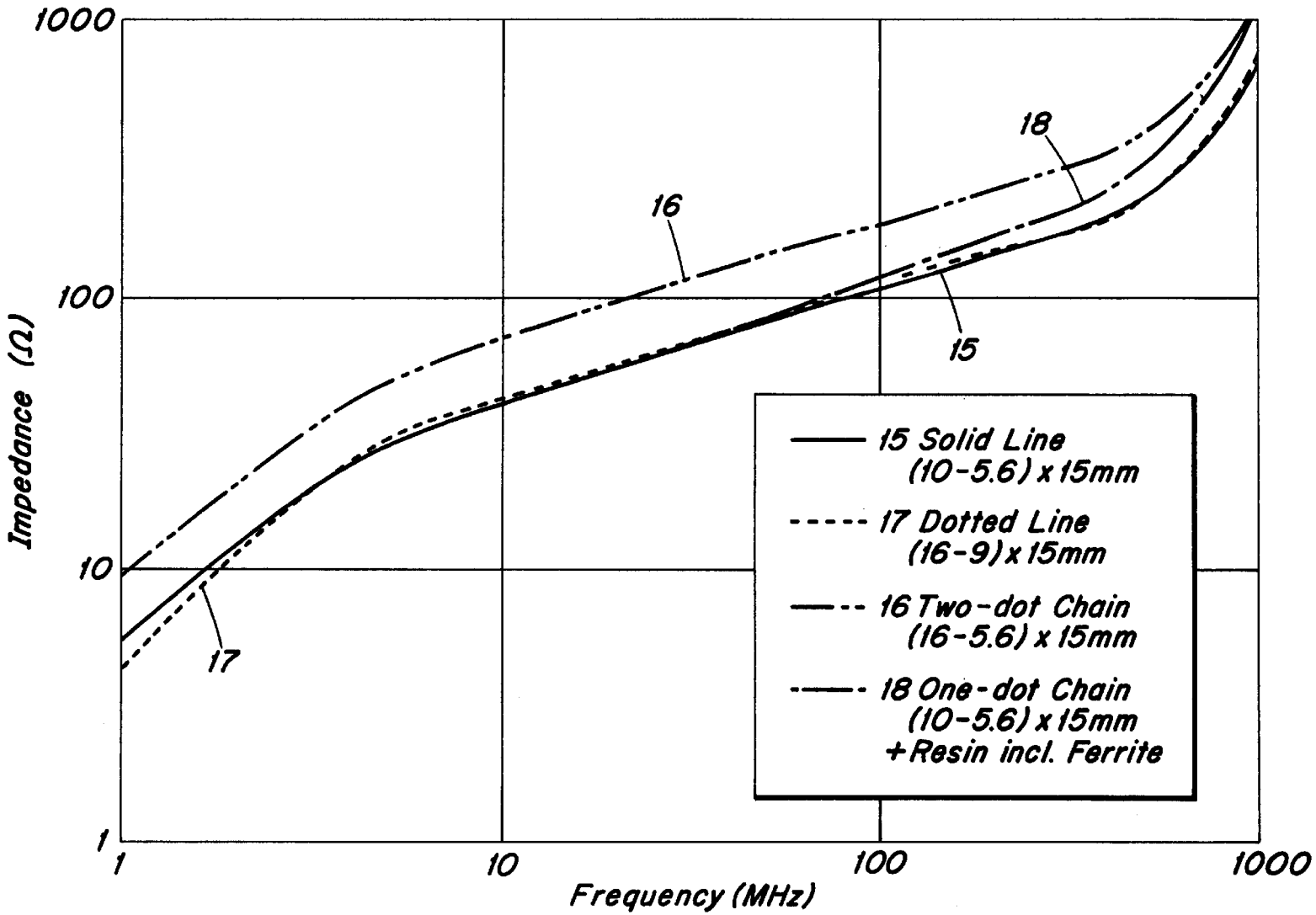
FIG. 3 is a graph showing the impedance characteristics of the insulated wire with the noise-suppressing function shown in FIG. 1.
Figure 11:
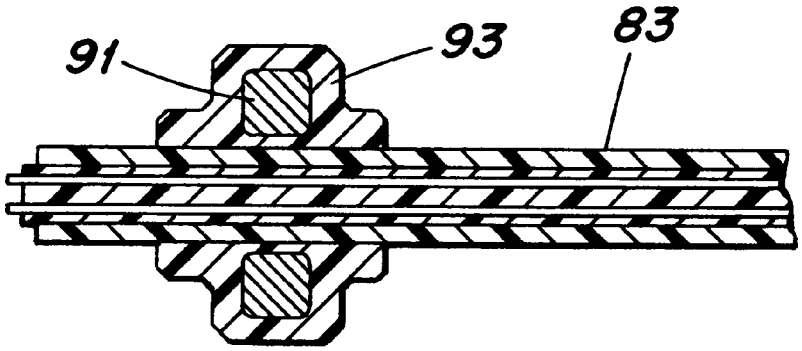
FIG. 11 (PRIOR ART)
FIG. 11 is a cross sectional view of the conventional configuration shown in FIG. 10.

The above conditions will be further described below with specific exemplary values. FIG. 3 is a graph indicating the impedance characteristics of an insulated wire 1 with a noise-suppressing function measured when a high-frequency signal having a frequency ranging from 1 MHz to 1000 MHz is applied to the pair of wires 6 in the insulated wire 1 in the same direction. The solid line 15 corresponds to a case in which the ring-shaped magnetic core 2 has an inner diameter of 5.6 mm, an outer diameter of 10 mm, a width of 15 mm, and a volume of about 0.8 $cm^3$. The two-dot chain line 16 corresponds to a case in which the ring-shaped magnetic core 2 has an inner diameter of 5.6 mm, an outer diameter of 16 mm, and a width of 15 mm. For comparison, the dotted line 17 indicates the impedance characteristic of a wire having the conventional structure shown in FIG. 11 (in which the ring-shaped magnetic core has an inner diameter of 9 mm, an outer diameter of 16 mm, a width of 15 mm, and a volume of about 2.0 $cm^3$).

The solid line 15 and the dotted line 17 show substantially the same impedance characteristic in FIG. 3. Therefore, it is understood that the insulated wire 1 with the noise-suppressing function according to the first embodiment has the same impedance characteristic as the conventional wire, even with the ring-shaped magnetic core 2 having a smaller size (about 40% in volume) than the conventional core. The two-dot chain line 16 shows a larger impedance than the dotted line 17. Therefore, it is understood that the insulated wire 1 with the noise-suppressing function according to the first embodiment has a larger impedance than the conventional wire when the ring-shaped magnetic core 2 has the same outer diameter as the conventional core.

When the securing member 10 includes magnetic powder, a noise-suppressing effect due to the securing member 10 having the magnetic powder is obtained in addition to that due to the ring-shaped magnetic core 2. Since the securing member 10 having the magnetic powder has a stronger noise-suppressing effect than the ring-shaped magnetic core 2 in a high frequency band (GHz band), the insulated wire 1 with the noise-suppressing function suppresses noise in a wide frequency band by the use of the securing member 10 having the magnetic powder.

The magnetic powder included in the securing member 10 is set such that it has an average particle diameter of about 1 to 100 $\mu$m and a content of about 20 to 70 percent by volume of the securing member 10. This is because of the fact that, if the magnetic powder has an average particle diameter of more than about 100 $\mu$m, it is difficult to knead the powder with resin or rubber, and if the magnetic powder has an average particle diameter of less than about 1 $\mu$m, a required magnetic permeability cannot be obtained. This is also because, if the magnetic-powder content becomes less than about 20 percent by volume, a required magnetic permeability cannot be obtained. It is preferred that the securing member 10 have a magnetic-powder content of 20 to 70 percent by volume to form as a unit the securing member 10 on the ring-shaped magnetic core 2 and the insulated wire 5 by cast molding or injection molding. However, the manufacturing method for the securing member 10 is not limited to cast molding or injection molding.

As the magnetic powder, Ni—Zn or Mg—Zn ferrite magnetic powder having a high resistivity or Mn—Zn ferrite magnetic powder having a low resistivity and magnetic metal powder having a low resistivity is used. The one-dot chain line 18 shown in FIG. 3 indicates an impedance characteristic in an embodiment in which Ni—Zn ferrite powder having an average particle diameter of 20 μm kneaded with vinyl chloride so as to have a content of 60 percent by volume (at a relative magnetic permeability of about 15) is used for the securing member 10 having magnetic powder, and the ring-shaped magnetic core 2 has an inner diameter of 5.6 mm, an outer diameter of 10 mm, and a width of 15 mm. The impedance indicated by the one-dot chain line 18 is larger than that indicated by the solid line 15, in the GHz band. Therefore, it is understood that the noise-suppressing effect is improved in a high-frequency band when the magnetic powder is included in the securing member 10.

Figure 4:
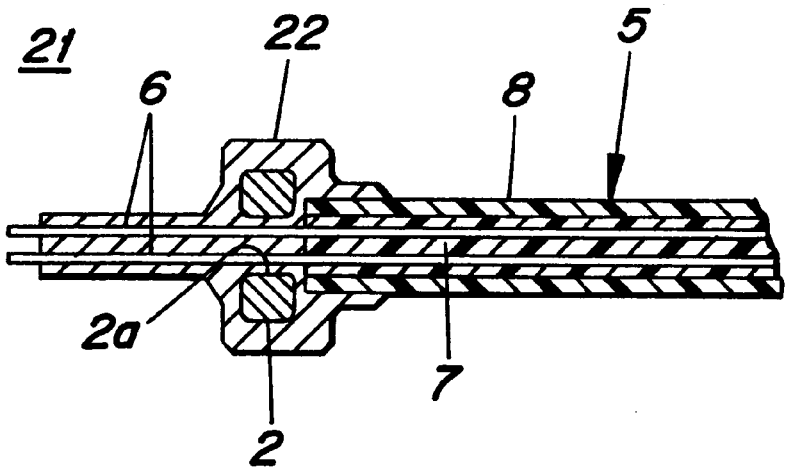
FIG. 4 is a cross sectional view of an insulated wire with a noise-suppressing function according to a second exemplary embodiment of the present invention.

FIG. 4 shows an insulated wire 21 with a noise-suppressing function according to a second embodiment of the present invention. It has the same structure as in the first embodiment except that a wire-coating member 7 is removed together with a sheath 8 at one end of an insulated wire 5. A pair of exposed conductive wires 6 without the wire-coating member 7 is inserted into the hole 2*a* of a ring-shaped magnetic core 2. The ring-shaped magnetic core 2 is disposed in the vicinity of the wire-coating member 7 and the sheath 8, and secured to the end of the insulated wire 5 with a securing member 22 being placed on the core 2. The insulated wire 21 with the noise-suppressing function having the above structure achieves the same functions and advantages as the insulated wire 1 with the noise-suppressing function according to the first embodiment.

When the securing member 22 includes magnetic powder in the same way as in the first embodiment, a noise-suppressing effect due to the securing member 22 having the magnetic powder is obtained in addition to that due to the ring-shaped magnetic core 2. When only the sheath 8 is removed as in the first embodiment, since insulation between the conductive wires 6 is ensured by the wire-coating member 7, the securing member 10 having the magnetic powder may have a low degree of insulation. When the wire-coating member 7 and the sheath 8 are removed as in the second embodiment, it is necessary to ensure insulation between the conductive wires 6, with the securing member 22 having the magnetic powder being placed around the wire. Therefore, Ni—Zn or Mg—Zn ferrite magnetic powder having a high resistivity is used for the magnetic powder included in the securing member 22.

In the insulated wire 21 with a noise-suppressing function, which has the securing member 22 with magnetic powder, since the securing member 22 forms a magnetic path between the conductive wires 6, a normal-mode noise suppressing effect due to the securing member 22 having the magnetic powder is also obtained in addition to a common-mode noise-suppressing effect due to the ring-shaped magnetic core 2. Only common-mode noise is suppressed in a configuration in which only the sheath 8 is removed as in the first embodiment. Also, only common mode noise is suppressed in a configuration according to the second embodiment in which the wire-coating member 7 and the sheath 8 are removed and the securing member 22 has no magnetic powder.

Figure 5:
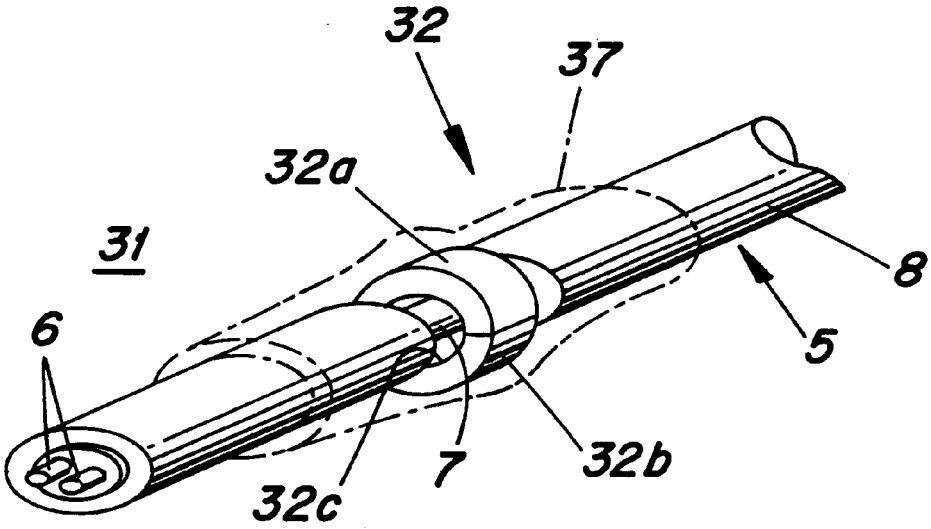
FIG. 5 is a perspective view of an insulated wire with a noise-suppressing function according to a third exemplary embodiment of the present invention.
Figure 6:
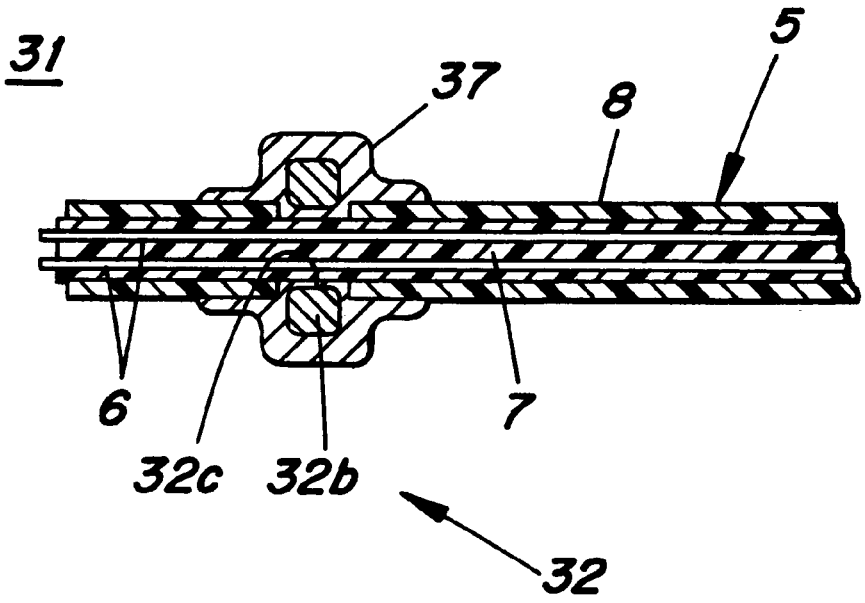
FIG. 6 is a cross sectional view of the insulated wire with the noise-suppressing function shown in FIG. 5.

FIGS. 5 and 6 show an insulated wire 31 with a noise-suppressing function according to a third embodiment of the present invention. It includes a ring-shaped magnetic core 32, a coated wire 5 passing through the hole 32*c* of the ring-shaped magnetic core 32, and a securing member 37 for securing the ring-shaped magnetic core 32 to the coated wire 5. The ring-shaped magnetic core 32 is formed of two divided core pieces 32*a* and 32*b*. The inner diameter of the ring-shaped magnetic core 32, namely the diameter of the hole 32*c*, is set smaller than the outer diameter of the coated wire 5.

A sheath 8 is removed from the coated wire 5 at a position a certain distance away from one end. The divided core pieces 32*a* and 32*b* are disposed such that they sandwich a portion of conductive wires 6, which are coated only with the wire-coating member 7. The divided core pieces 32*a* and 32*b* butt against each other to form the ring-shaped magnetic core 32.

The insulated wire 31 with the noise-suppressing function having the above structure achieves the same functions and advantages as the insulated wire 1 with the noise-suppressing function described in the first embodiment, and in addition, the ring-shaped magnetic core 32 can be mounted at any position on the insulated wire 31 to provide the noise-suppressing function. Therefore, it is not necessary to mount the ring-shaped magnetic core to an end of the insulated wire 31 to provide the noise-suppressing function. The ends of the wire may have a normal structure and it becomes easy to handle the wire 31 when the wire is connected to a component.

The securing member 37 may include magnetic powder so that a noise-suppressing effect due to the securing member 37 having the magnetic powder is also obtained in addition to a noise-suppressing effect due to the ring-shaped magnetic core 32.

Figure 7:
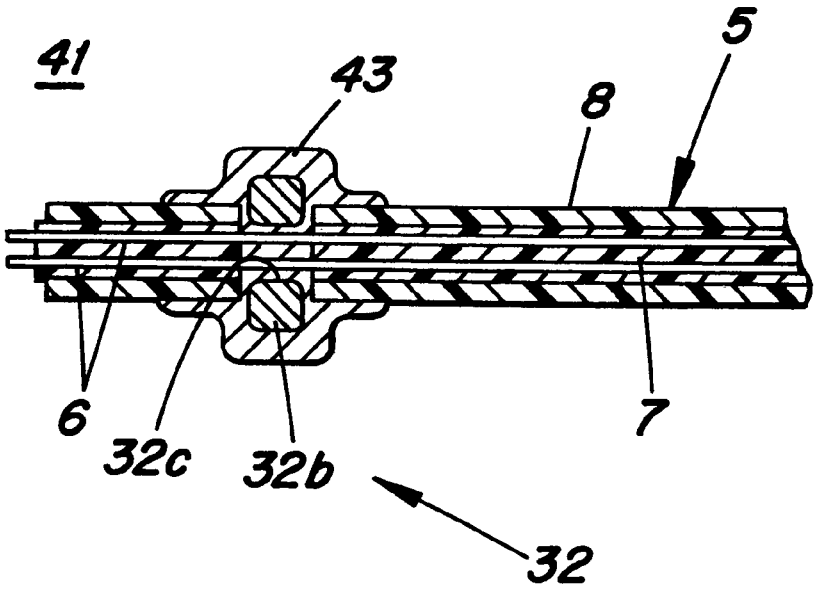
FIG. 7 is a cross sectional view of an insulated wire with a noise-suppressing function according to a fourth exemplary embodiment of the present invention.

FIG. 7 shows an insulated wire 41 with a noise-suppressing function according to a fourth embodiment of the present invention. It has the same structure as in the third embodiment except that a wire-coating member 7 is removed together with a sheath 8 at a position a certain distance away from one end of a coated wire 5. An exposed part of a pair of conductive wires 6 without the wire-coating member 7 is inserted into the hole 32*c* of a ring-shaped magnetic core 32. The ring-shaped magnetic core 32 is formed of two divided core pieces 32*a* and 32*b* (the divided core piece 32*a* is not shown in FIG. 7). The ring-shaped magnetic core 32 is covered by a securing member 43 and secured to the coated wire 5.

The insulated wire 41 with the noise-suppressing function having the above structure achieves the same functions and advantages as the insulated wire 31 with the noise-suppressing function described in the third embodiment. The securing member 43 may include magnetic powder so that a noise-suppressing effect (including a normal-mode noise-suppressing effect) due to the securing member 43 having magnetic powder is also obtained. Ni—Zn or Mg—Zn ferrite (or like material) magnetic powder having a high resistivity is used for the magnetic powder in order to ensure insulation between the conductive wires 6.

Figure 8:
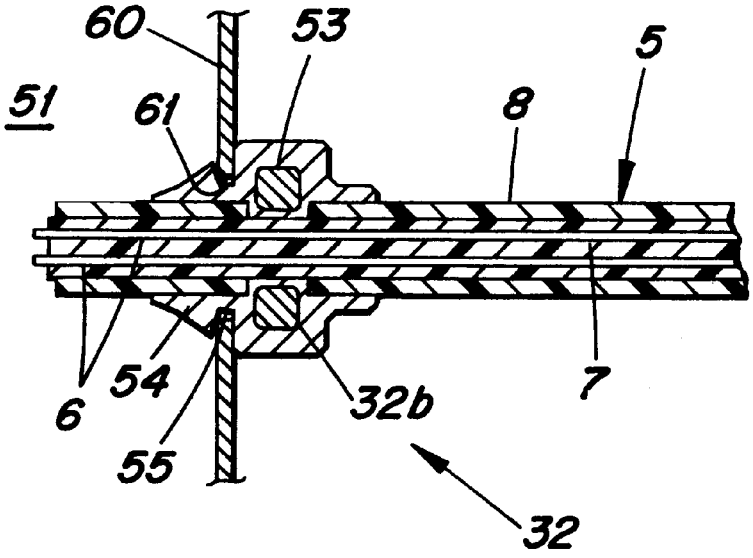
FIG. 8 is a cross sectional view of an insulated wire with a noise-suppressing function according to a fifth exemplary embodiment of the present invention.
Figure 9:
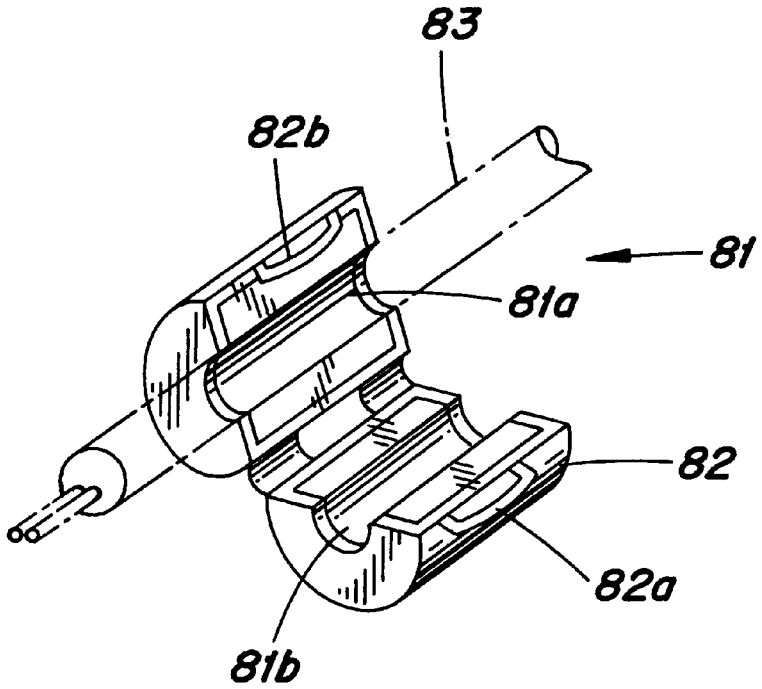
FIG. 9 (PRIOR ART)
FIG. 9 is a perspective view of a conventional configuration.
Figure 10:
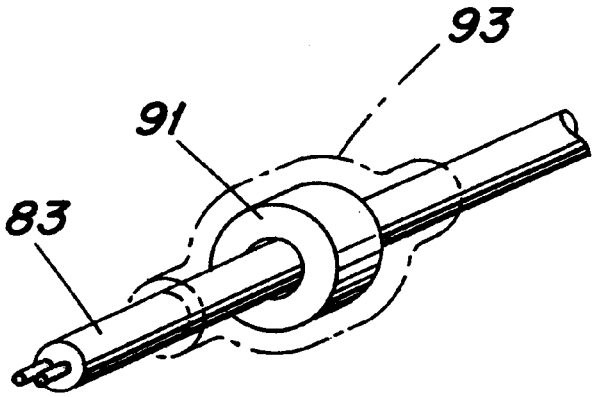
FIG. 10 (PRIOR ART)
FIG. 10 is a perspective view of another conventional configuration.

FIG. 8 shows an insulated wire 51 with a noise-suppressing function according to a fifth embodiment of the present invention. It uses a securing member 53 both for securing a ring-shaped magnetic core 32 to a coated wire 5 and as a securing bushing used for mounting the coated wired 5 to the case of an electronic unit.

A sheath 8 is removed from the coated wire 5 at a position a certain distance away from one end. Divided core pieces 32*a* and 32*b* (the divided core piece 32*a* is not shown in FIG. 8) are disposed such that they sandwich a portion of conductive wires 6, which are coated only with a wire-coating member 7. The divided core pieces 32*a* and 32*b* butt against each other to form the ring-shaped magnetic core 32.

Since the securing member 53 includes magnetic powder, a noise-suppressing effect due to the securing member 53 having the magnetic powder is also obtained in addition to a noise-suppressing effect due to the ring-shaped magnetic core 32. Therefore, the insulated wire 51 with the noise-suppressing function which can suppress noise in a wide frequency band is obtained. The securing member 53 is provided with a securing flange 54 at one end. The securing flange 54 is pressed into a hole 61 of the case 60 of an electronic unit so that the securing member 53 is hooked at the hole 61 by a narrow portion 55. The securing member thus works as a securing bushing.

The insulated wire 51 with the noise-suppressing function having the above structure achieves the same functions and the same advantages as in the third embodiment. Since the size of the ring-shaped magnetic core 32 is smaller than the conventional ring-shaped magnetic core, the securing member 53 having the magnetic powder, in which the ring-shaped magnetic core 32 is housed, is only slightly larger in size than a conventional securing bushing without a magnetic core, and the size is not noticeably increased even with the ring-shaped magnetic core. The insulated wire 51 with the noise-suppressing function is, therefore, easily handled.

An insulated wire with a noise-suppressing function according to the present invention is not limited to the above exemplary embodiments. It can be modified in various ways within the scope of the invention. For instance, the ring-shaped magnetic core is not limited to a circular ring. It may be a rectangular ring.

What is claimed is:

1. An insulated wire with a noise-suppressing function, comprising:

a wire;

an insulating sheath, which has an outer diameter, disposed around said wire, except for at least a portion along the length of said wire at which said sheath is removed;

an insulating wire-coating member between said wire and said sheath;

a ring-shaped magnetic core disposed around said wire at said portion at which said sheath is removed; and a securing member which secures said ring-shaped magnetic core to said portion;

wherein said ring-shaped magnetic core has an inner diameter which is less than said outer diameter of said sheath;

wherein said securing member includes a magnetic powder dispersed therein.

2. The insulated wire with a noise-suppressing function according to claim 1, wherein said portion at which said sheath is removed is located at a distal end of said wire.

3. The insulated wire with a noise-suppressing function according to claim 1, wherein said portion at which said sheath is removed is located between two sections of said wire having said sheath disposed around said wire.

4. The insulated wire with a noise-suppressing function according to claim 1, wherein said wire-coating member is present at said portion at which said sheath is removed.

5. The insulated wire with a noise-suppressing function according to claim 1, wherein said wire-coating member is removed at said portion at which said sheath is removed, wherein said securing member separates said magnetic core from said wire.

6. The insulated wire with a noise-suppressing function according to claim 1, wherein said ring-shaped magnetic core is formed by a plurality of divided core pieces.

7. The insulated wire with a noise-suppressing function according to claim 1, wherein said securing member is structured to serve as a bushing.

8. The insulated wire with a noise-suppressing function according to claim 7, wherein said securing member further includes a U-shaped notch for use in coupling said securing member to a hole in a casing of an electronic unit.

9. The insulated wire with a noise-suppressing function according to claim 1, wherein said securing member is made from at least one of either resin or rubber.

10. The insulated wire with a noise-suppressing function according to claim 1, wherein an average particle diameter of said magnetic powder is about 1 to 100 $\mu$m and said magnetic powder content ranges from about 20 to 70 percent by volume of said securing member.

11. The insulated wire with a noise-suppressing function according to claim 1, wherein said magnetic powder is composed of a material having high resistivity.

12. The insulated wire with a noise-suppressing function according to claim 11, wherein said material comprises one of either Ni—Zn or Mg—Zn magnetic powder.

13. The insulated wire with a noise-suppressing function according to claim 11, wherein said securing member is directly formed around and in contact with a portion of said wire.

14. The insulated wire with a noise-suppressing function according to claim 1, wherein said magnetic powder is composed of a material having low resistivity.

* * * * *